United States Patent [19]

Gragson et al.

[11] 4,115,562

[45] Sep. 19, 1978

[54] TREATED FABRICS AND PROCESS

[75] Inventors: James T. Gragson, Bartlesville, Okla.; Joseph E. Ballard, Greenville, S.C.

[73] Assignee: Phillips Petroleum Company, Bartlesville, Okla.

[21] Appl. No.: 776,686

[22] Filed: Mar. 11, 1977

Related U.S. Application Data

[62] Division of Ser. No. 591,921, Jun. 30, 1975, Pat. No. 4,029,639.

[51] Int. Cl.[2] ..... C08G 75/16; B29C 25/00

[52] U.S. Cl. ..... 264/234; 66/169 R; 139/420 R; 264/235; 264/342 RE; 264/345; 528/373

[58] Field of Search ..... 264/342 R, 342 RE, 345, 264/234, 235; 66/169 R; 260/79, 79.1; 428/910, 913; 139/420 R

[56] References Cited

U.S. PATENT DOCUMENTS

| | | | |
|---|---|---|---|
| 2,705,880 | 4/1955 | Kinzinger et al. | 66/191 |
| 2,952,033 | 9/1960 | Goodwin | 264/346 |
| 3,354,129 | 11/1967 | Edmonds et al. | 260/79 |
| 3,526,693 | 9/1970 | Rulison et al. | 264/346 |
| 3,562,199 | 2/1971 | Hill, Jr. et al. | 264/346 |
| 3,898,204 | 8/1975 | Short et al. | 260/79 |
| 3,919,177 | 11/1975 | Campbell | 260/79.1 |
| 3,948,865 | 4/1976 | Brady et al. | 264/331 |

*Primary Examiner*—Jeffery R. Thurlow

[57] ABSTRACT

Fabrics produced from aromatic sulfide polymers are rendered water-repellent by heat treatment near, but below, the melting point of the polymer for a finite period of time. The resulting heat-treated fabric is suitable for flame retardant tents, waterproof clothing, filters, etc.

7 Claims, No Drawings

TREATED FABRICS AND PROCESS

This application is a division of copending Ser. No. 591,921, filed June 30, 1975, entitled "Treated Fabrics and Process," now U.S. Pat. No. 4,029,639, issued June 14, 1977.

This invention relates to the production of improved fabrics produced from aromatic sulfide polymer fibers. In accordance with another aspect, this invention relates to a process for heat treating fabrics made from phenylene sulfide polymers at a temperature below the melting point of the polymer to render the heat-treated fabric water-repellent. In accordance with a further aspect, this invention relates to the production of a water-repellent fabric of phenylene sulfide fibers which has been heat treated under conditions which render the fabric water-repellent. In accordance with a further aspect, this invention relates to the heat treatment of fabrics produced from aromatic sulfide polymers at a temperature below the melting point of the polymer where the physical properties can be improved without changing the basic form of the polymer.

Articles made from fibers produced from aromatic sulfide polymers possess many desirable properties because of the strength, high melting point, and nonburning characteristics of the fibers. The articles and fibers from which they are made are also attractive for use in corrosive atmospheres and applications because the polymers from which the fibers are made are highly resistant to most chemicals including commonly used acids and bases. The fibers can be formed into yarn and fabrics formed from the yarn by knitting, weaving, and other known means for producing fabrics including nonwoven fabrics.

In accordance with the invention, it has been found that fabrics and other similar articles produced from fibers of aromatic sulfide polymers can be improved with respect to water-repellency by heat treating at a temperature below the crystalline melting point of the polymer.

Accordingly, it is an object of this invention to improve the physical properties of articles of manufacture produced from aromatic sulfide resins.

Another object of this invention is to provide a process for the production of water-repellent fabrics from aromatic sulfide polymer fibers or yarns.

A further object of this invention is to provide articles of manufacture from phenylene sulfide polymers having improved physical properties.

Other objects, aspects, and the several advantages of the invention will be apparent to those skilled in the art upon a study of this disclosure and the appended claims.

In accordance with the invention, water-repellent articles, especially fabrics, are produced from aromatic sulfide polymer fibers by heat treating the article under relaxed conditions at a temperature below the crystalline melting point of the polymer for a finite period of time sufficient to render the article water-repellent.

In accordance with another embodiment of the invention, knitted, nonwoven, and woven fabrics produced from phenylene sulfide polymer fibers are heat treated in a relaxed state at a temperature near, but below, the crystalline melting point of the polymer for a finite period of time sufficient to render the fabric water-repellent.

In accordance with a preferred embodiment, fabrics formed from poly(phenylene sulfide) fibers are subjected to a heat treatment at a temperature of about 5° C to about 25° C below the crystalline melting point of the polymer for a period of time sufficient to render the fabric water-repellent without changing the basis form of the fabric.

In accordance with another specific embodiment of the invention, the fibers used in the formation of the articles, especially fabrics which can be treated, are strong, high-modulus, high-melting, nonburning fibers produced from aromatic sulfide polymers such as phenylene sulfide polymers by melt spinning a polymer which has been partially cured to a melt flow in the range of 75–800 and then drawing the melt-spun filaments in the molten state. The melt-drawn fibers can be additionally improved by drawing in the solid state after cooling.

The melt-spun fibers have a very high melting point [285° C for poly(phenylene sulfide)], are nonburning as they have an LOI (Limiting Oxygen Index) of 35 (will not burn in an atmosphere containing less than 35 volume percent oxygen), and are highly resistant to chemical attack. Fabrics made from these fibers are especially suitable for high-temperature applications such as industrial filter bags, for nonburning applications such as draperies, upholstery, wall coverings, clothing, etc., and for other applications where the special properties of the fibers are desired. The conditions for producing the strong, high-modulus, high-melting, nonburning fibers described above are set forth in U.S. Pat. No. 3,898,204, issued Aug. 5, 1975, to James N. Short et al.

The term "phenylene sulfide polymer" as used in this specification is intended to include polymers of the type which are prepared as described in U.S. Pat. No. 3,354,129, issued Nov. 21, 1967, to Edmonds and Hill, and which can be at least partially cured to obtain polymers with a melt flow of 75 to 800. Melt flow of these polymers is measured by ASTM method D-1238-70 modified for operation at 650° F (343° C) with a piston load of 5 kilograms. As disclosed in the Edmonds and Hill patent, these polymers can be prepared by reacting a polyhalo-substituted aromatic compound containing unsaturation between adjacent ring atoms and a mixture in which at least one alkali metal sulfide is contacted with at least one organic amide. The resulting polymer contains the aromatic structure of the polyhalo-substituted aromatic compound coupled in repeating units through a sulfur atom. The polymers which are preferred for use in this invention, because of their high thermal stability and availability of raw materials, are those polymers having the repeating unit —R—S— where R is phenylene or a lower alkyl-substituted derivative thereof. By "lower alkyl" is meant alkyl groups having 1 to 6 carbon atoms such as methyl, propyl, isobutyl, n-hexyl, and the like. Thus, the term "phenylene sulfide polymers" is intended to include not only the phenylene group, but also the lower alkyl-substituted phenylene groups. The preparation of such polymers is well disclosed in the above-mentioned patent of Edmonds et al. In a presently preferred embodiment, poly(phenylene sulfide) is prepared by reacting p-dichlorobenzene with a mixture in which sodium sulfide is contacted with N-methyl-2-pyrrolidone as described in Example I in the Edmonds and Hill patent. Other polymers prepared as described in the Edmonds and Hill patent are suitable for preparation of the fibers of our invention providing the polymers can be cured to a melt flow in the 75 to 800 range.

In addition to the above-mentioned phenylene sulfide polymers that can be used to produce fibers for the fabrics of the invention, other phenylene sulfide polymers that can be used include those disclosed and claimed in U.S. Pat. No. 3,919,177, issued Nov. 11, 1975. According to said patent, p-phenylene sulfide polymers are produced by reacting at least one p-dihalobenzene with a mixture in which at least one source of sulfur, at least one alkali metal carboxylate, and at least one organic amide are contacted. With applicable sulfur sources other than alkali alkali metal sulfides and alkali metal bisulfides, at least one base is also required. Use of the carboxylates results in p-phenylene sulfide polymers of higher molecular weight, as evidenced by higher inherent viscosity and lower melt flow. The polymers of said patent do not have to be cured. Representative examples of suitable p-dihalobenzenes, suitable alkali metal carboxylates, suitable organic amides, and suitable sources of sulfur, as well as conditions for producing the p-phenylene sulfide polymers are set forth in detail in said patent which is incorporated herein by reference.

The preferred polymers for use in our invention are those having crystalline melting-point temperatures above about 200° C. The preferred phenylene sulfide polymers can have crystalline melting-point temperatures in the range from about 200° C (392° F) to about 330° C (626° F). Polymers of phenylene sulfide usually have crystalline melting points in the range from about 250° C (482° F) to 300° C (572° F). However, it is believed that other aromatic sulfide polymers such as phenylene sulfide polymers having higher crystalline melting temperatures ranging up to about 500° C can be satisfactorily melt spun into fibers according to the invention. In the event that polymers having crystalline melting temperatures above about 325° C are used, a modified melt flow evaluation procedure would need to be developed as the ASTM method D-1238-70, as presently modified, is capable of measuring the melt flow properties of polymers having melting temperatures below 650° F (343° C).

The preferred polymers before curing have an inherent viscosity as measured in 1-chloronaphthalene at 206° C at a polymer concentration of 0.4 g/100 ml solution of at least 0.15, more preferably between 0.15 and 0.25, and in some instances between 0.18 and 0.22. Melt flow of the polymers before curing is usually above 4,000, much too high for preparation of suitable fibers. After curing, it is difficult, if not impossible, to measure inherent viscosity of the polymer because of its very high molecular weight. We, therefore, use melt flow as a more reliable measure of the suitability of the polymer for the preparation of fibers.

The heat treatment of this invention can be accomplished at temperatures near, but below, the crystalline melting point of the polymer. In general, the heat treatment can be accomplished at temperatures between about 5° C and about 25° C below the crystalline melting point of the polymer. A more preferred temperature range is from about 260° C to about 275° C for poly(-phenylene sulfide).

The time for which the polymer is heat treated at the foregoing temperatures varies from a few minutes to several hours. In general, it has been found that a period of time from about eight minutes to about eight hours is sufficient for the heat treatment of poly(phenylene sulfide) fibers to render the thus-treated article water-repellent. The temperature and time are interdependent and also dependent upon such factors as nature of polymer and properties desired.

The articles treated according to the invention can be previously subjected to a heat-set treatment at a much lower temperature under tension. Usually, the heat-set treatment is carried out at temperatures of the order of about 175° C to about 230° C. Most often, the heat-set treatment will be carried out at temperatures at least 50° C less than the heat treatment described above to produce a water-repellent product. The heat-set treatment is ineffective to produce fabrics that are water-repellent. The amount of tension applied during the heat-set treatment will ordinarily be about 80–200 g using a tenter frame.

The heat treatment according to the invention for producing water-repellent products is carried out under relaxed conditions, i.e., the article is not under tension in any direction.

If desired, the heat treatment can be carried out under either nonoxidizing or oxidizing conditions. The heat treatment is more economically carried out in air but an inert atmosphere heat treatment may be desirable to prevent discoloration or change in pigments if present in the yarn.

EXAMPLE I

A fabric was prepared by weaving a 350/68 poly(-phenylene sulfide) yarn into a 1 over 3 twill (yarn in one direction goes over and under every thread; thread in another direction goes over and under every three threads). The yarn was made from nominal 5-denier filament twisted into a yarn containing 68 filaments and having a total denier of about 350, hence 350/68 yarn.

The resultant fabric was heat-set at 200° C for two minutes on a tenter frame under low (100 g) tension. The fabric was readily wetted by tap water.

EXAMPLE II

Samples of the fabric from Example I were subjected to a heat treatment in a tenter frame under no tension for eight minutes and eight hours, respectively, at 270° C. The melting point of the polymer is about 285° C.

The samples were simply hung in the tenter frame which was placed into a muffle furnace at 270° C for the test period.

Results: Both samples were water-repellent and drops of water would bead but would not penetrate the fabric. The fabric which had been held at 270° C for eight hours was a darker brown and a little stiffer than the fabric which has been treated for only eight minutes.

All fabric samples, including the control, were tested for salient physical properties to determine if the higher heat treatment temperatures had seriously affected these properties and thus rendered the fabric less useful. The table below shows the results of these tests.

| Heat Treatment Temp. | Time | Breaking[1] Strength, g | Elongation Percent | Initial[2] Modulus Load, g (Avg.) | Fabric Property |
|---|---|---|---|---|---|
| — | — | 898 | 40 | 5,623 | Water permeable |
| 270° C | 8 min. | 808 | 37 | 6,300 | Water-repellent; water beads on surface |
| 270° C | 8 hrs. | 800 | 36 | 4,600 | Water-repellent; water beads on |

-continued

| Heat Treatment Temp. | Time | Breaking[1] Strength, g | Elongation Percent | Initial[2] Modulus Load, g (Avg.) | Fabric Property |
|---|---|---|---|---|---|
| | | | | | surface |

[1]ASTM D 1682-64.
[2]ASTM D 885 S 3.14.
Heat-set conditions for all samples were 200° C, 2 min.

The results show that the heat-treated fabrics were not appreciably weakened by the treatment, even after eight hours at 270° C. It would appear, however, that the shorter residence time for this treatment is more desirable.

In summary, a fabric made from poly(phenylene sulfide) fibers or yarns can be rendered water-repellent by treating the fabric, in a relaxed state, at a temperature near, but below, the melting point of the polymer for a period of 8 minutes to several hours. We claim:

1. A process for improving the physical properties of fabrics of phenylene sulfide polymer fibers comprising heat treating in a relaxed state a fabric made from phenylene sulfide polymer fibers that have been drawn in the solid state at least about three to about eight times to provide a high degree of orientation and have been produced from polymers having a melt flow within the range of 75 to 800 grams per 10 minutes as measured by ASTM method D-1238-70 modified to operate at 650° F with a piston load of 5 kilograms at an elevated temperature near, but from about 5° C to about 25° C below, the crystalline melting point of the polymer for a finite period of time sufficient to render the fabric water-repellent but under conditions of temperature and time such that the treatment does not cause degradation of physical properties or discoloration of the fabric.

2. A process according to claim 1 wherein said fibers are melt-spun fibers formed from poly(phenylene sulfide) and said fibers have been drawn in the solid state at least about three to about eight times to provide a high degree of orientation in said fibers, said fabric prior to said heat treatment is heat set under a tension of about 80–200 g using a tenter frame by subjecting same to an elevated temperature in the range of from about 175° C to about 230° C, and then subjecting the heat-set fabric to heat treatment at a temperature of about 260° C to about 275° C for a finite period of time up to about eight hours to form a water-repellent fabric.

3. A process according to claim 1 wherein said fibers are formed from poly(phenylene sulfide) and said heat treatment is carried out at a temperature in the range of about 260° C to about 275° C for a finite period of time up to about 8 hours.

4. A process according to claim 1 wherein said fabric is produced from melt-spun, high-modulus, high-melting, nonburning phenylene sulfide polymer fibers formed from a least partially cured phenylene sulfide polymers.

5. A process according to claim 1 wherein said fibers are formed from poly(phenylene sulfide).

6. A process according to claim 1 wherein said fabric prior to said heat treatment is heat set under tension by subjecting same to an elevated temperature which is at least about 50° C below the temperature at which said heat treatment is effected and said fabric is subjected to said elevated temperature for a period of time sufficient to effect heat set.

7. A process according to claim 6 wherein said fabric is formed from poly(phenylene sulfide) fibers and said heat set is carried out at a temperature of about 200° C and then the fabric is subsequently heat treated at about 260° C to about 275° C for a finite period of time of up to about 8 hours.

* * * * *